US010399084B2

(12) United States Patent
Dale et al.

(10) Patent No.: US 10,399,084 B2
(45) Date of Patent: Sep. 3, 2019

(54) MEDIA SCREENING DEVICES FOR CAPTURING MEDIA DURING A DEBURRING PROCESS

(71) Applicant: Raytheon Company, Waltham, MA (US)

(72) Inventors: Erik T. Dale, Tucson, AZ (US); Luis E. Silva, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 29 days.

(21) Appl. No.: 15/721,595

(22) Filed: Sep. 29, 2017

(65) Prior Publication Data

US 2019/0099761 A1 Apr. 4, 2019

(51) Int. Cl.

| | |
|---|---|
| ***B24B 31/00*** | (2006.01) |
| ***B02C 17/16*** | (2006.01) |
| ***B24B 31/12*** | (2006.01) |

(52) U.S. Cl.

CPC ..... *B02C 17/161* (2013.01); *B24B 31/00* (2013.01); *B24B 31/12* (2013.01)

(58) Field of Classification Search

CPC ..... B24B 31/00
USPC ..... 451/32, 326, 328, 330, 442
See application file for complete search history.

(56) References Cited

U.S. PATENT DOCUMENTS

| | | | | |
|---|---|---|---|---|
| 3,680,266 A * | 8/1972 | Shiplov | B24B 31/06 366/112 | |
| 4,044,957 A | 8/1977 | Schold | | |
| 4,140,283 A | 2/1979 | Szkaradek | | |
| 4,739,936 A | 4/1988 | Stehr | | |
| 4,742,966 A | 5/1988 | Szkaradek et al. | | |
| 5,486,135 A * | 1/1996 | Arpaio | B24B 9/06 451/326 | |
| 5,794,865 A | 8/1998 | Didion et al. | | |

(Continued)

FOREIGN PATENT DOCUMENTS

| | | |
|---|---|---|
| DE | 3243390 C1 | 2/1984 |
| EP | 2915628 A1 | 9/2015 |
| JP | H07-040227 A | 2/1995 |

(Continued)

OTHER PUBLICATIONS

International Search Report for International Application No. PCT/US2018/044255 dated Dec. 5, 2018, 14 pages.

*Primary Examiner* — Robert A Rose

(57) ABSTRACT

A system for screening deburring media during deburring operations of a hardware part comprises a deburring machine comprising a media slurry basin, a deburring media slurry disposed in the media slurry basin, and a media screening device freely movable within the deburring media slurry to define a dynamic zone of capture to capture noncompliant media. The media screening device can comprise a housing defining an inner chamber, and can comprise a plurality of openings each sized to restrict compliant deburring media from passing through the opening, and each opening sized to permit passage of noncompliant deburring media into the inner chamber. Each opening can comprise a counterbore. The media screening device can comprises at least one removable housing body removably coupled to the housing to facilitate removal of captured noncompliant deburring media. A method is disclosed for screening deburring media during deburring of a hardware part.

20 Claims, 5 Drawing Sheets

(56) References Cited

U.S. PATENT DOCUMENTS

2014/0065929 A1 3/2014 Davidson et al.

FOREIGN PATENT DOCUMENTS

JP H09-183065 A 7/1997
JP 2002-301664 A 10/2002

* cited by examiner

MEDIA SCREENING DEVICES FOR CAPTURING MEDIA DURING A DEBURRING PROCESS

BACKGROUND

Different sizes and types of media can be used in a tumble vibratory deburr machine for deburring a hardware part, such as a machined part. Over time, the media wears as the part is tumbled, vibrated, and consequently deburred. The size of the media decreases as the media wears, and often gets stuck or lodged in the hardware part being deburred (such as in blind holes). Sometimes this lodged media is not found in the hardware part until after the part is assembled with other parts in an assembly. In many cases, removing the lodged media may not be possible with out damage to the hardware part and/or the assembly. Thus, the media must be screened to remove worn media, and then replaced with new media, on a regular basis to avoid the aforementioned issues. However, using conventional screening processes requires the deburring machine to be taken offline (deburring of parts to cease) for a period of time, which can disrupt the manufacturing process, cost valuable time, and increase overall costs.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
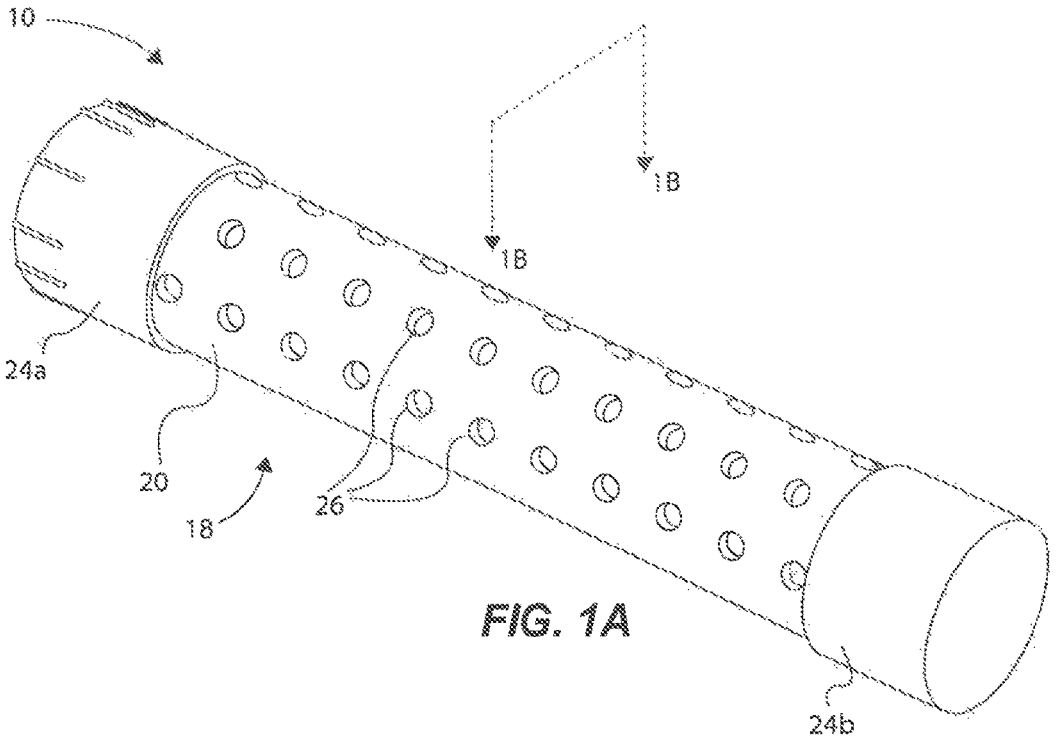
FIG. 1A is an isometric view of a media screening device in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

In one example, there is provided a system for screening deburring media during deburring operations of a hardware part (i.e., performing the screening process during or simultaneous with the actual deburring process of a hardware part). The system can comprise a deburring machine comprising a media slurry basin; a deburring media slurry disposed in the media slurry basin (the deburring machine can be operable to agitate the deburring media slurry to deburr a hardware part); and a media screening device freely movable within the deburring media slurry during a deburring operation to define a dynamic zone of capture, and configured to capture noncompliant deburring media.

In one example, the media screening device comprises a housing defining an inner chamber, and having a plurality of openings. Each opening can be selectively and specifically sized to restrict compliant deburring media from passing through the opening, and selectively and specifically sized to permit passage of noncompliant deburring media into the inner chamber, thereby capturing the noncompliant deburring media within the media screening device.

In one example, the media screening device comprises at least one removable housing body removably coupled to the housing to facilitate removal of captured noncompliant deburring media. In one example, some or all of the openings of the plurality of openings can comprise a two-stage opening (e.g., a counterbore defining a shoulder, with a first stage of the opening comprising a first size (e.g., a first diameter) and a second stage comprising a different size (e.g., a smaller second diameter)). Stated differently, some or all of the openings can comprise a two-stage opening configuration with a first large opening formed concentric with a smaller, recessed opening.

In one example, the deburring machine comprises a tub-type deburring machine configured to agitate the deburring media slurry generally around a horizontal axis and generally in a wave motion. And, the media screening device can comprise a generally cylindrical housing configured to move generally around the horizontal axis and to rotate around one or more of its own axes (e.g., a longitudinal axis, one or more lateral axes, or all of these).

In one example, the deburring machine comprises a bowl-type deburring machine configured to agitate the deburring media slurry around a vertical axis and generally in a whirlpool motion. And, the media screening device can comprise a generally spherical housing configured to move generally around the vertical axis and to rotate about one or more of its own axes.

In one example, the media screening device is configured to capture noncompliant media in real-time during deburring operations of the hardware part with the deburring machine.

In one example, there is provided a method for screening deburring media during deburring of a hardware part. The method can comprise introducing a hardware part into a deburring media slurry supported by a deburring machine; introducing a media screening device into the deburring media slurry; and operating the deburring machine to move the hardware part and the media screening device about the deburring media slurry to capture noncompliant media in the media screening device, wherein the media screening device moves freely within the deburring machine.

In one example, the method comprises removing the media screening device from the deburring media slurry; removing the noncompliant media from within the media screening device; and re-introducing the media screening device into the deburring media slurry.

In one example, there is provided a media screening device operable with a deburring machine, wherein the media screening device is configured to be freely movable about a deburring media slurry of a deburring machine while deburring a hardware part. The media screening device can comprise: a housing comprising at least one wall defining an inner chamber, and a plurality of openings disposed through the at least one wall. Each opening can comprise an outer opening area and an inner opening area, wherein the outer opening area is sized larger than the inner opening area so as to define a shoulder (i.e., a two-stage opening configuration), and wherein the inner opening area is sized to restrict compliant deburring media from passing through the inner opening area opening, and sized to permit noncompliant deburring media to pass through the inner opening area, thereby capturing the noncompliant deburring media within the inner chamber. The media screening device can comprise at least one removable housing body removably coupled to the housing to facilitate removal of captured noncompliant deburring media.

Figure 1B:
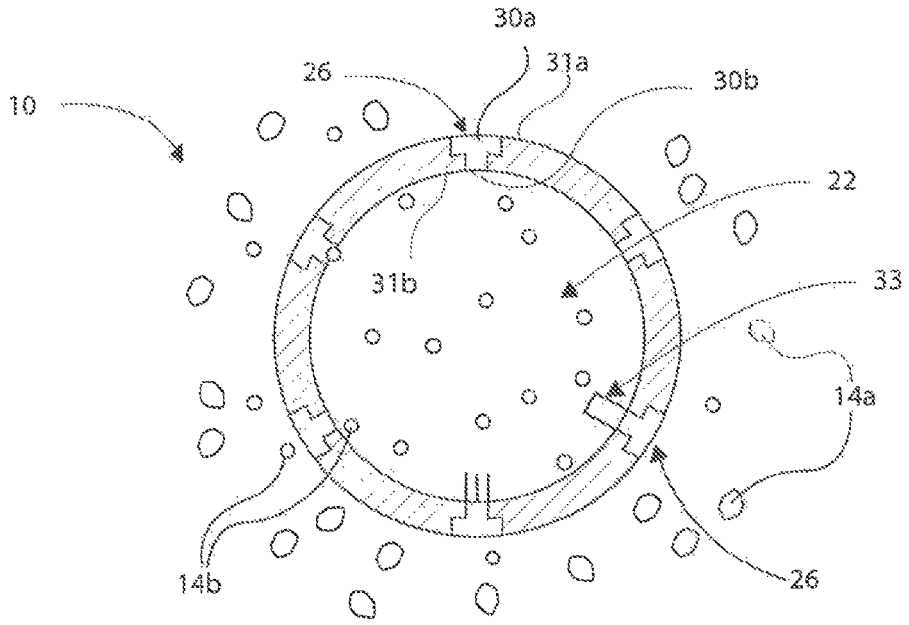
FIG. 1B is a cross sectional view of the media screening device of FIG. 1A, taken along lines 1B-1B.
Figure 2:
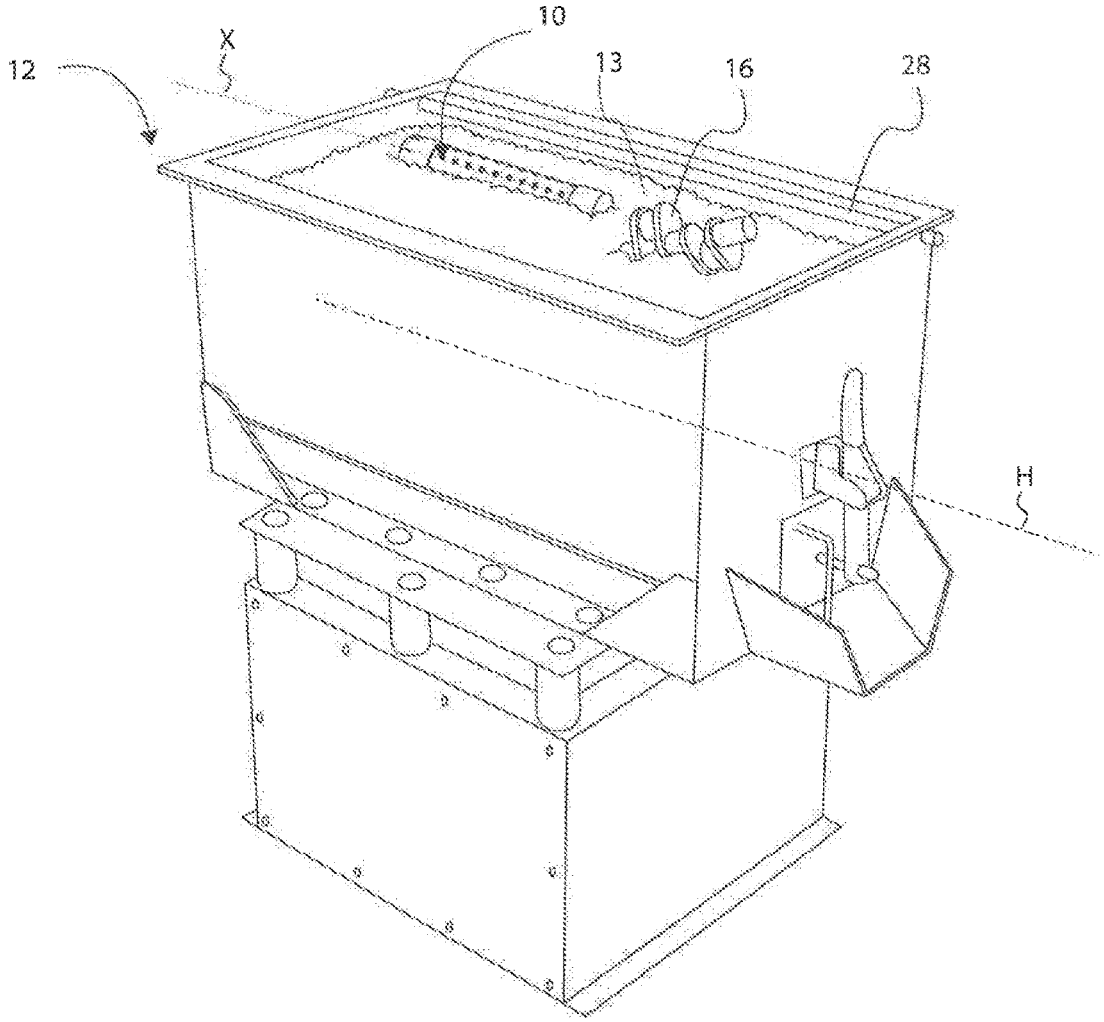
FIG. 2 illustrates a system for screening deburring media, during deburring operations of a hardware part, using, for example, the media screening device of FIG. 1A (or that of FIG. 1C), in accordance with an example of the present disclosure.

To further describe the present technology, examples are now provided with reference to the figures. With reference to FIGS. 1A, 1B, and 2, a media screening device 10 is disclosed that is operable with a deburring machine 12 for screening deburring media (14*a*, 14*b*), of a deburr media slurry 13, such as during deburring of a hardware part 16 (the specific hardware part shown being merely exemplary). As will be explained below, the media screening device 10 is configured to screen compliant media and noncompliant media 14*a* and 14*b*, and to capture noncompliant media 14*b* in real-time during a deburring operation. The media screening device 10 can comprise a housing 18 comprising a perimeter wall 20 defining an inner volume or chamber 22 that is enclosed by the perimeter wall 20. In one example, the housing 18 can be configured to be generally cylindrical in shape. The housing can comprise open ends, with the media screening device 10 further comprising at least one housing enclosure (e.g., see housing enclosures 24*a* and 24*b*) that can be configured to be removably coupled to the housing 18 to enclose the end(s) of the housing and the chamber 22, as well as to provide selective access to the chamber 22 (i.e., an enclosure that selectively covers and uncovers an opening through the housing 18 to enclose and access the chamber 22). In one aspect, the removable housing enclosure 24*a* can be a cylindrically shaped (inside) threaded end cap that is threadably coupled to an outside threaded end of the housing 18 (alternatively, the enclosure 24*a* can be a plug having outer threads that engage with inside or inner threads formed on the inside of the end of the housing 18). Such removable housing enclosure 24*a* can be removed from the housing 18 by hand (or by a tool or machine), thereby opening or exposing the chamber 22. The other removable housing enclosure 24*b* can be similarly configured so as to be removable, or it can be secured to the housing 18 using adhesive or a type of fastener. The removable housing enclosures 24*a* and 24*b* can further define the chamber 22 along with the perimeter wall 20 of the housing 18. Note that a second housing enclosure may not be necessary, for example where the housing 18 has an end wall formed as part of the perimeter wall 20. Those skilled in the art will recognize that the media screening device 10 can comprise other types of elements and features used to enclose the chamber 22, as well as to provide selective access to the chamber 22.

The housing 18 can comprise a plurality of openings 26 disposed through (or formed through) the perimeter wall 20. These can be randomly positioned about the housing 18, they can be positioned in accordance with a pattern, such as evenly and radially or annularly positioned or disposed around the perimeter wall 20 of the housing 18. As illustrated in FIG. 1B, the openings 26 can be sized to restrict compliant deburring media 14*a* from passing through the openings 26 during a deburring operation of the hardware part 16 (see FIG. 2). On the other hand, the openings 26 can also be sized to permit noncompliant deburring media 14*b* to pass through the openings 26, thereby capturing the noncompliant deburring media 14*b* within the chamber 22 of the media screening device 10.

"Noncompliant deburring media" can mean a particle of deburring media that has a cross sectional area (e.g., a profile), in at least one plane, that is smaller than the smallest cross sectional area (e.g., a profile) of each opening 26 (e.g., the inner opening area 30*b*), such as to allow the particular noncompliant deburring media to pass through the opening 26 and into the chamber 22. And, "compliant deburring media" can mean a particle of deburring media capable of suitably performing a deburring function on a part or workpiece, and that has a cross sectional area (e.g., a profile), in at least one plane, that is larger than the smallest cross sectional area (e.g., a profile) of each opening 26 (e.g., the inner opening area 30*b*), such as to restrict the particular compliant deburring media from passing through the opening 26 and into the chamber 22.

More specifically, the media screening device 10 can be operable with the deburring machine 12 having a media slurry basin 28 (e.g., a tumbler-type deburring machine having a media slurry tub or basin) that contains or supports the media slurry 13, the hardware part 16, and the media screening device 10, such that the media screening device 10 is introduced into, or maintained within, the basin 28 during a deburring operation. Such tumbler-type deburring machines are well known and will not be discussed in great detail. However, the deburring machine 12 can comprise an agitator mechanism (not shown) that agitates the media slurry 13 to tumble, vibrate, and consequently deburr the hardware part 16. The media slurry 13 can comprise a two-part slurry: 1) deburr media (particles), and 2) a liquid. The deburr media (14*a*, 14*b*) and the liquid can be mixed together to form the media slurry 13 (e.g., for "wet barrel" finishing). The deburr media (14*a*, 14*b*) can comprise particles comprised of ceramic, plastic, synthetics, carbon steel shot, stainless steel shot, hardwood, aluminum oxide grit, white aluminum, corn cob, silicon carbide grit, walnut shells, and other known deburring media. The liquid can be any type of suitable liquid for providing a media slurry, such as known alkaline cleaners that can be mixed with the deburr media to form the media slurry 13.

Therefore, the deburring machine 12 can be configured to agitate and move the media slurry 13, such that the media slurry 13 rolls in waves generally around a horizontal axis H along the media slurry basin 28. The hardware part 16 can be introduced into the media slurry 13, such that the deburr media (14*a*, 14*b*) of the media slurry 13 can constantly contact various surfaces of the hardware part 16 to deburr burrs or other slight defects or protrusions of the hardware part 16, as known in the industry for deburring of a hardware part. The hardware part 16 can be any type suitable for undergoing a deburring finishing step, such as a single piece of hardware, such as steel or aluminum machined parts that are machined by a CNC machine, for instance, and that are later assembled in an assembly. It will be recognized that any available piece of hardware that needs deburred can benefit from the use of the media screening devices disclosed herein.

Notably, the media screening device 10 can also be introduced into the media slurry 13, along with the hardware part 16, such that the media screening device 10 is freely movable about the media slurry 13 (much like the hardware part 16 is freely movable about the media slurry 13). "Freely movable" means that the media screening device 10 is not coupled or attached to any other structure, but rather floats within the media slurry 13, as further discussed below. Because of the general cylindrical shape of the media screening device 10, it can maintain a general horizontal position generally parallel to the horizontal axis H as it moves throughout the media slurry 13, as shown in FIG. 2. In addition to such movement about the media slurry 13, the media screening device 10 can rotate about its own elongated axes (e.g., longitudinal, one or more lateral axes, or any or all of these) as it moves about the media slurry 13. Thus, as the media screening device 10 is moving about the media slurry 13, it is also rotating on its own axis of rotation X, which allows the media screening device 10 to maximize its movement about the media slurry basin 28. This further maximizes the amount of noncompliant media 14*b* that it can capture, so as to reduce the amount of noncompliant media 14*b* available that can potentially become lodged in the hardware part 16. In this manner, the media screening device 10 provides a dynamic zone of capture as it moves about the media slurry basin 28. Indeed, the zone of capture of the non-compliant media 14*b* is dynamically changing and moving within the media slurry basin 28 as the media slurry 13 is agitated, and as the media screening device 10 is caused to move about the media slurry basin 28.

As discussed above, over time the compliant deburring media 14*a* will wear down to a smaller size (or decrease in size) as compared to its original form when introduced into the slurry, thereby becoming "noncompliant" deburring media 14*b*. Such noncompliant deburring media 14*b* poses a risk of being lodged or trapped in portions of the hardware part 16. This can be very problematic once the hardware part 16 is incorporated into an assembly, because removing such lodged noncompliant deburring media 14*b* can result in destruction of the hardware part 16, and even the assembly it is later coupled to. Thus, as the deburring machine 12 agitates the media slurry 13 during normal deburring operations, the media screening device 10 screens the compliant media 14*b*, while capturing the noncompliant media 14*b* inside the chamber 22. This function is performed in real time during the deburring of the hardware part 16, but as the media screening device 10 does not capture any compliant media 14*a*, these are caused to remain active for their intended purpose, namely to deburr the hardware part 16, while at the same time at least a portion of the non-compliant media 14*b* is removed from the media slurry 13 before these can become lodged within the hardware part 16. It is noted that those skilled in the art will recognize that the media screening device 10 can be operated with the deburring machine 12 to screen the media in the media slurry without the hardware part being present. Indeed, the presence of a hardware part within the deburring machine is not necessary for the media screening device to function properly. However, although not necessary, certain advantages are realized when the media screening device is operated with the hardware part simultaneously during a deburring process, as described herein, such as to enable the manufacturing process to continue uninterrupted, to avoid the lodging of worn down and smaller media in the part being manufactured, and others as will be apparent to those skilled in the art.

Once the chamber 22 of the media screening device 10 becomes full with an amount of noncompliant media 14*b*, an operator can remove the media screening device 10 from the media slurry 13, then remove the removable housing enclosure 24*a* from the housing 18, and then remove or empty and dispose of the captured noncompliant media 14*b*. The operator can then replace the removable housing enclosure 24*a* by removably coupling or joining it to the housing 18, and then re-introduce the now empty media screening device 10 into the media slurry 13 to capture additional noncompliant media 14*b* that may be in the media slurry 13. Advantageously, this process of removing and emptying the media screening device 10 can occur while continuing to operate the deburring machine 12 to deburr the hardware part 16. In other words, the deburring process can be continuous with hardware part 16 not taken "offline" from its manufacturing production flow in order to screen-out any noncompliant media 14*b* that may exist in the media slurry 13. That is, a single process flow to completely deburr the hardware part 16 is uninterrupted by executing the methods discussed above with respect to the media screening device 10, unlike existing systems in which the process and production flow is interrupted by turning off the deburring machine so as to be able to remove the media slurry, and then sift or separate any noncompliant media with a sieve-type screen. Once this has been achieved, the media slurry with the compliant media can be replaced, and the deburring machine brought online again to resume deburring the hardware part. This is both time consuming and costly because is interrupts production flow of the hardware part, thereby losing production time. This is also burdensome because the media slurry is quite heavy, so an operator must lift and remove all the media slurry from the deburring machine, screen it, then replace the compliant media and the slurry back into the deburring machine.

Referring again to FIG. 1B, the plurality of openings 26 can be openings radially formed around the perimeter wall 20 of the housing 18. In one example, each opening 26 can further comprise a counterbore. More specifically, one or more of the openings 26 formed in the housing 18 can comprise an outer opening 30*a* sized larger than an inner opening 30*b*. Both the inner and outer opening areas 30*a* and 30*b* can be cylindrically shaped, thereby having a circular cross sectional area through which deburring media may (or may not pass). Alternatively, such cross sectional areas can be oval, rectangular, polygonal, irregular, etc. In the cylindrical counterbore example of FIG. 1B, the counterbore can be formed having linear surfaces. In the example shown, an outer surface 31*a* of the housing 18 can transition to a vertical surface of the outer opening area 30*a*, and then transition inwardly toward the vertical surfaces of the inner opening area 30*b*, and ultimately to the inner surface 31*b* of the housing 18, as shown in FIG. 1B. Basically, the openings of FIG. 1B can comprise a larger cylindrical opening (the outer opening area 30*a*) adjacent a smaller cylindrical opening (the inner opening area 30*a*), as formed through the perimeter wall 20 of the housing 18, as a counterbore formed from an outside area of the housing 18 to the inside area of the housing 18. Stated another way, the openings 26 can comprise a two-stage configuration, as discussed above.

Alternatively, each opening can be formed having a converging linear shape, such as a portion of a conical-shaped opening where an outer opening area or portion has a larger cross sectional area than an inner opening area or portion, such that the larger opening area is adjacent an outer surface (e.g., 31*a*) and transitions/converges to the smaller opening area adjacent an inner surface (e.g., 31*b*) of the housing 18. Such conical-shaped opening can be formed using a tapered drill bit, or formed via a tapered mold portion in examples where the housing is molded.

In another alternative, each opening can have an outer opening area that has curved surfaces converging inwardly to an inner opening area, such as might be formed with a rounded-head counterbore drill bit that forms the outer opening area by partially drilling through the housing, and that forms the inner opening area with a smaller drill bit extending from the larger diameter rounded drill bit. This can form a hemispherical outer opening area, which can better trap and move a particular noncompliant deburring media toward the inner opening area because of the smooth, rounded side surfaces that assist to slide the noncompliant deburring media toward the inner opening area.

In any event, in the illustrated example of FIG. 1B, a particular particle of noncompliant media 14*b* can be more easily captured by the (larger) outer opening area 30*a* of the opening 26, and then finally caused to pass through the (smaller) inner opening area 30*b* (if the particle is small enough to pass through completely). And, once captured, the noncompliant media 14*b* may be more easily retained in the chamber 22 because of the configuration of the counterbore formed through the housing 18. That is, because the inner opening area 30*b* is only slightly larger in cross sectional area than a particular noncompliant media 14*b*, it is more difficult for it to pass back through the inner opening area 30*b* of the counterbore (like a crab trap). Thus, each opening 26 can be configured as a "trap" that can more readily trap and capture noncompliant media 14*b* that would be moving around the outside of the media screening device 10, while preventing the captured media 14*b* in the chamber 22 from falling out of or traversing back through the openings 26 and back into the media slurry 13.

Further to this trapping concept, one or more of the openings 26 can further comprise an extended opening portion 33 that terminates beyond the inner surface of the perimeter wall 20, or in other words, that extends beyond the inner surface of the perimeter wall 20 into the chamber 22. This can be accomplished by configuring the media screening device 10 with structure operable to extend the openings 26 into the chamber 22. In one example, the extended opening portion 33 of the openings 26 can extend from the inner opening area 30*b* inwardly into the chamber 22 toward a central area of the media screening device 10. Specifically, the extended opening portion 33 can be defined by one or more protrusions that are formed about and that extend from the inner surface 31*b* of the perimeter wall 20, and in a generally perpendicular direction from the inner surface 31*b*. In one aspect, the extended opening portion 33 can comprise a structural configuration defining an extended opening area having the same cross-sectional size and shape as the inner opening area 30*b*. In this configuration, the extended opening portion 33 can comprise an annular wall that extends from the inner surface 31*b* of the perimeter wall 20 and that circumscribes the inner opening area 30*b* of the opening 26. In another aspect, the extended opening portion 33 can comprise a series of posts or post-like protrusions that extend from the inner surface 31*b* of the perimeter wall 20 and that circumscribe the inner opening area 30*b* of the opening 26. The extended opening portion 33 can take on other configurations as will be apparent to those skilled in the art, each of which are contemplated herein. Thus, any captured noncompliant media 14*b* would be further prevented from exiting the chamber 22 through the openings 26 because of the difficult path for the noncompliant media 14*b* (i.e., passing through the extended opening portion 33), particularly when the captured noncompliant media 14*b* is dynamically moving or rotating within the chamber 22. It is noted that although FIG. 1B illustrates an extended opening portion 33 about one of the openings 26 formed in the media screening device 10 in the form of an annular wall, and another extended portion 33 about an adjacent opening 26 in the form of a series of posts or post-like protrusions, it is contemplated that a plurality or all of the openings 26 in the media screening device 10 can comprise an extended opening portion similar to the example extended opening portions 33 shown. Moreover, those skilled in the art will recognize that any of the media screening devices discussed herein, can comprise openings having an extended opening portion as taught herein. Still further, the extended openings 33 can comprise a variety of structural configurations designed to operate for their intended purpose.

In the example of FIG. 1A (and of FIG. 1C) the media screening device 10 can be formed generally as a cylindrical elongated body that can roll along or with the waves of the media slurry 13 when the deburring machine 12 agitates the media slurry 13. Thus, during operation, any captured noncompliant media 14*b* would roll around the inner chamber 22 with some angular velocity, which makes it even more difficult for the captured noncompliant media 14*b* to laterally pass back through the relatively small inner opening area 30*b* of each opening 26 (because it s traveling angularly relative to the center axis of the opening 26). In some examples, the outer opening area 30*a* of the counterbore can be configured as an elongated slot formed at least partially annularly around the outer surface of the housing 18 to further facilitate capturing the noncompliant media 14*b* that may be moving around the outside of the housing 18 during deburring of the hardware part 16. Such annular slots can intercept or trap noncompliant deburring media 14*b*, and then transition the noncompliant deburring media 14*b* along the slot to the inner opening area 30*b* to thereby capture it inside the inner chamber 22.

In one example, the deburr media (e.g., 14*a*) of the deburring media slurry 13 can be originally sized at approximately ¾-⅜ of an inch, and the inner opening area 30*b* of each opening 26 can be sized slightly smaller than ⅜ of an inch in diameter (or overall cross sectional area) so as to prevent such media from passing therethrough. However, the deburring media can comprise any shape and size, and the media screening device can be configured as needed or desired to accommodate different sized deburring media. For example, the housing 18 can have an inside diameter as needed or desired (e.g., 1 to 3 inches (or more)), and any length desired or needed (e.g., a length of approximately 4 to 12 inches (or more)). Accordingly, the inner chamber volume can be any needed or desired volume. Thus, where the openings 26 are each sized slightly smaller than the defined or predetermined compliant media, any deburring media that is generally smaller than that will be considered noncompliant deburring media intended to pass through the openings 26, thereby becoming captured in the inner chamber 22 for later removal. In another example, the media screening device 10 (and other screening devices) can be on a microscale level where the housing diameter is just a few millimeters, such that the deburr media is originally sized on a micron level, and such that the media screening device captures sub-micron sized noncompliant media. In any scenario, the media screening device 10 is freely movable (e.g., unattached to any structure or device) about the media slurry 13 for capturing noncompliant media 14*b*.

Figure 1C:
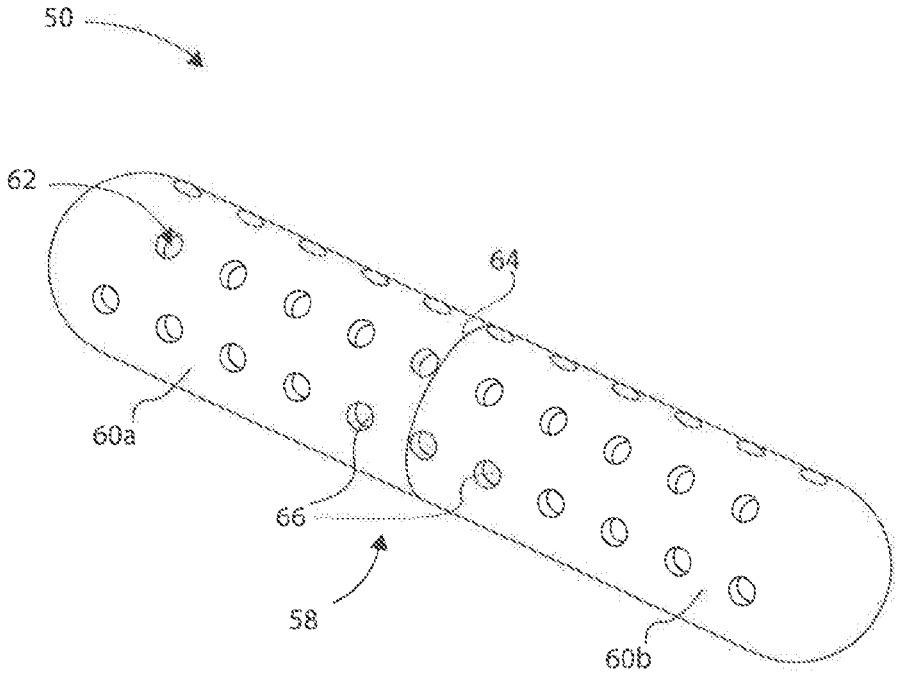
FIG. 1C is an isometric view a media screening device in accordance with an example of the present disclosure.

Referring to FIGS. 10 and 2, FIG. 1C illustrates another example of a media screening device 50 operable with the deburring machine 12 for screening deburring media 14 during deburring of the hardware part 16. In this example, the media screening device 50 can comprise a housing 58 defined by a first housing body 60*a* and a second housing body 60*b*, and that define an inner chamber 62. Each housing body 60*a* and 60*b* can be generally cylindrically shaped (having rounded or flat ends), and can be removably coupled to each other via a coupling portion 64, such as by a threaded interface or other suitable mechanism (e.g., fasteners). The first and second housing bodies 60*a* and 60*b* can be uncoupled (e.g., unthreaded) from each other via the coupling portion 64, thereby exposing respective inner chambers of each housing body 60*a* and 60*b* that define the overall inner chamber 62 of the housing 58. Similar to FIGS. 1A and 1B, the first and second housing bodies 60*a* and 60*b* can each comprise a plurality of openings 66 formed through the respective housing bodies. And each opening 66 can be sized to restrict compliant deburring media (e.g., 14*a*) from passing through the openings 66 during a deburring operation of the hardware part 16 (FIG. 2), and can be sized to permit noncompliant deburring media (e.g., 14*b*) to pass through the openings 66, thereby capturing the noncompliant deburring media (e.g., 14*b*) within the inner chamber 62. Therefore, with reference to FIG. 2, as the deburring machine 12 agitates the media slurry 13 during normal deburring operations, the media screening device 50 can capture the noncompliant media (e.g., 14*b*) inside the inner chamber 62. The media screening device 50 does not capture compliant media (e.g., 14*a*), thereby allowing these to continue to function to deburr the hardware part 16.

Once the media screening device 50 is suitably full with noncompliant media 14*b* in the inner chamber 62, an operator can remove the media screening device 50 from the media slurry 13, and then uncouple the first housing body 60*a* from the second housing body 60*b*, so that the operator can dispose of or remove the captured noncompliant media (e.g., 14*b*). Then, the operator can re-couple or rejoin the first and second housing bodies 60*a* and 60*b*, and then re-introduce the now empty media screening device 50 into the media slurry 13 to capture additional noncompliant media. This process of removing and emptying the media screening device 50 can occur while continuing to operate the deburring machine 12 to deburr the hardware part 16, such as is discussed herein.

Figure 3A:
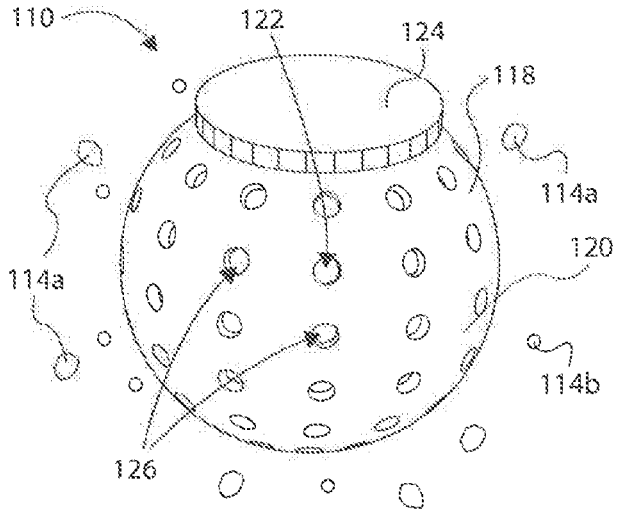
FIG. 3A is an isometric view a media screening device in accordance with an example of the present disclosure.
Figure 3B:
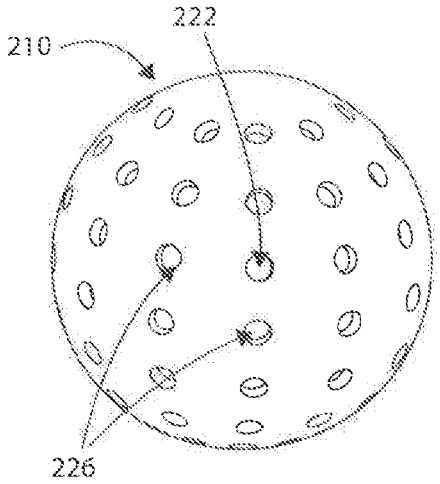
FIG. 3B is an isometric view a media screening device in accordance with an example of the present disclosure.

FIG. 3A illustrates an example of a media screening device 110, and FIG. 3B illustrates another example of a similar media screening device 210, both of which are operable with a deburring machine 112 (FIG. 4) for screening deburring media 114 during deburring of a hardware part 116. The media screening devices 110 and 210 are similar in many respects to the media screening devices discussed above. As such, the above discussion is intended to be referred to, where applicable, in understanding the media screening devices 110 and 210. The media screening device 110 can comprise a housing 118 comprising a perimeter wall 120 defining an inner chamber 122. In one example, the housing 118 is generally spherically shaped and comprises at least one removable housing enclosure 124 that is removably coupled to the housing 118 about an opening. In one aspect, the removable housing enclosure 124 can be a threaded end cap that is threadably coupled to a threaded opening of the housing 118. Such removable housing enclosure 124 can be removed, thereby opening or exposing the inner chamber 122. The removable housing enclosure 124 can further define the inner chamber 122 along with the housing 118. Note that the removable housing enclosure 124 is shown raised above or protruding from the outer surface of the housing 118, but it could be recessed such that the media screening device 110 is more generally spherical all the way around the media screening device 110.

Alternatively, the housing 118 can be defined by two similarly shaped hemisphere components removably coupled to each other, such as via a threaded interface formed about a circumferential mid-line of the spherically shaped housing 18 (the two components operating in a manner similar to the device of FIG. 1C). In this manner, an operator can turn the first hemisphere relative to the second hemisphere, thereby accessing the inner chamber 122, and opening the device 110 to remove any captured noncompliant media therein.

Figure 4:
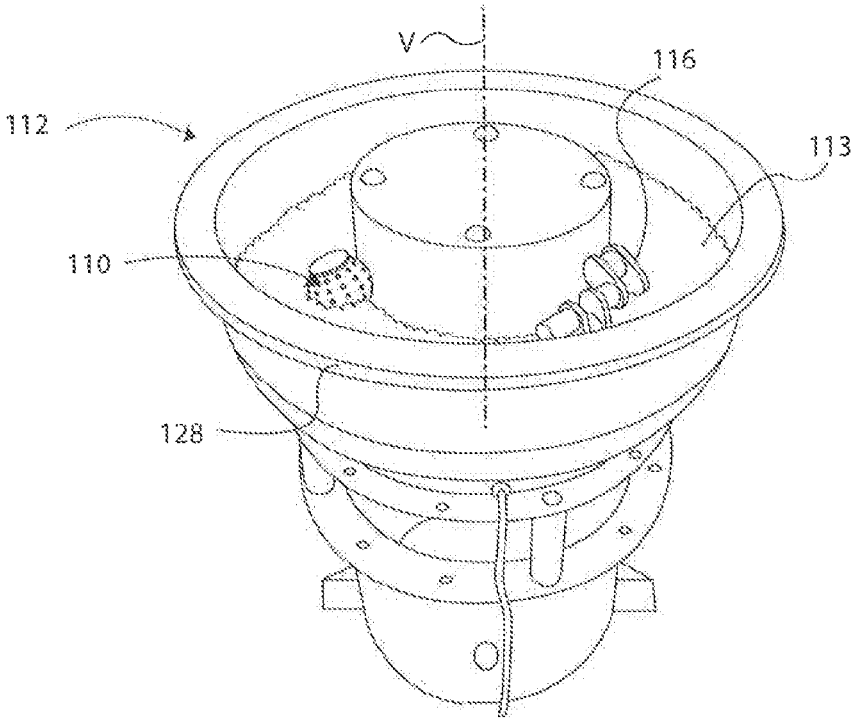
FIG. 4 illustrates a system for screening deburring media, during deburring operations of a hardware part, with the media screening device of FIG. 3A (or FIG. 3B) in accordance with an example of the present disclosure.

Similar to FIGS. 1A and 1B, the housing 118 can comprise a plurality of openings 126 disposed through (or formed through) the perimeter wall 120 and radially around the perimeter wall 120. Similar to the description of FIG. 1B, each opening 126 is sized to restrict compliant deburring media 114*a* from passing through the openings 126 during a deburring operation of the hardware part 116 (FIG. 4). And, each opening 126 is sized to permit noncompliant deburring media 114*b* to pass through the openings 126, thereby capturing the noncompliant deburring media 114*b* within the inner chamber 122 of the media screening device 110.

More specifically, as shown on FIG. 4, the media screening device 110 can be operable with a deburring machine 112 having a media slurry basin 128, such as a whirlpool-type deburring machine having a tub that holds and supports the media slurry 113, the hardware part 116, and the media screening device 110. Such whirlpool-type deburring machines are well known and will not be discussed in great detail. However, the deburring machine 112 can comprise an agitator mechanism (not shown) that agitates the media slurry 113 generally about a vertical axis V in a whirlpool like manner to deburr the hardware part 116. The media slurry 113 can be similar to the media slurry 13 discussed above with respect to FIG. 2. The hardware part 116 can be introduced into the media slurry 113, such that the deburring media particles of the media slurry 113 can constantly and randomly contact various surfaces of the hardware part 116 to deburr unwanted burrs, as known in the industry for deburring a hardware part.

Notably, the media screening device 110 can also be introduced into the media slurry 113, along with the hardware part 116, such that the media screening device 110 is freely movable about the media slurry 113 (much like the hardware part 116 is freely movable about the media slurry 113). Because of the general spherical shape of the media screening device 110, it can maintain a circular movement motion around the slurry basin 128 and throughout the media slurry 13. In addition to such movement, the media screening device 110 can rotate about various axes as it moves about the media slurry 113 generally around the vertical axis V. Thus, as the media screening device 110 is moving in the media slurry 113 and also spinning/rotating, this allows the media screening device 110 to automatically capture noncompliant media 14*b* and to provide a dynamic zone of capture within the media slurry basin 128, which thereby maximizes the amount of noncompliant media 114*b* that it can capture during use. Advantageously, the media screening device 10 can be utilized with many existing deburring machines without any modification of such machines, and without interrupting production flow of the hardware part 16, as discussed herein.

As discussed above, over time the deburring media particles 114*a* will wear down to a smaller size than originally formed (i.e., compliant media 114*a* become noncompliant media 114*b*), thereby posing the risk of such noncompliant media 114*b* being lodged or trapped in portions of the hardware part 116. Thus, as the deburring machine 112 agitates the media slurry 113 during normal deburring operations, the media screening device 110 captures the noncompliant media 114*b* inside the inner chamber 122. The media screening device 110 does not capture compliant media 114*a*, thereby allowing these to continue to deburr the hardware part 116. Once the media screening device 110 is full with noncompliant media 114*b*, an operator can remove the media screening device 110 from the media slurry 113, remove the removable housing enclosure 124 from the housing 118, and dispose of the captured noncompliant media 114*b*. Then, the operator can re-couple or rejoin the removable housing enclosure 124 to the housing 118, and then re-introduce the now empty media screening device 110 into the media slurry 113 to capture additional noncompliant media 114*b*. This process of removing and emptying the media screening device 110 can occur while continuing to operate the deburring machine 112 to deburr the hardware part 116. Advantageously, the hardware part 116 is not taken "offline" from its manufacturing production flow in order to screen-out any noncompliant media 114*b* that may exist in the media slurry 113. That is, a single process flow to deburr the hardware part 116 is uninterrupted by executing the method discussed above with the media screening device 110, in one example.

Similarly as described regarding FIG. 1B, the plurality of openings 126 can be openings formed through and around the perimeter wall 120 of the housing 118. In one example, each opening 126 can comprise a counterbore to provide a two-stage opening, such as shown in FIG. 1B, to capture and trap the noncompliant media 114*b* in a similar manner. Alternatively, each opening 126 can take other forms, as specified above regarding the discussion of FIG. 1B.

In this example the media screening device 110 is formed generally as a spherical body that rolls and rotates with the media slurry 113 in a whirlpool manner as the deburring machine 112 agitates the media slurry 113. Thus, during operation, any captured noncompliant deburring media 114*b* may freely roll around the inner chamber 122 with some angular direction relative to the housing wall, which makes it even more difficult for the captured noncompliant media 114*b* from passing back through the relatively small inner opening area (e.g., 30*b*) of the openings 126 (when formed as a counterbore).

In one example, the deburring media can be originally sized at approximately ¾-⅜ of an inch, and the inner opening area (e.g., 30*b*) of the openings 126 can be sized slightly smaller than ⅜ of an inch in diameter. The housing 118 can have a diameter of approximately 1 to 6 inches, and an inner chamber volume of 0.5 cubic inches up to 115 cubic inches, or more. Thus, where the smallest area of the openings 126 are sized slightly smaller than ⅜ of an inch in diameter, any noncompliant media 114*b* that is generally smaller than ⅜ of an inch can pass through the openings 126, thereby becoming captured in the inner chamber 122 for later removal. Other dimensions can be possible without deterring from the principle use and configuration of the media screening device 110, such as the ability to screen deburring media originally sized at 1 inch or more where the housing diameter can be 6 inches or more. And in another example, the media screening device 110 can be on a microscale level where the housing diameter is just a few millimeters such that the deburr media is originally sized on a micron level.

In any scenario, the media screening device 110 is freely movable about a media slurry for capturing noncompliant media. Said another way, the media screening device 110 is unattached to any structure or component. As discussed above, this advantageously allows for continued processing of the hardware part 116 without taking it offline, all while removing noncompliant media 114*b* from the media slurry 113.

FIG. 3B shows a media screening device 210 that can be disposable, or for one-time use, meaning that once the media screening device 210 becomes full of noncompliant media (e.g., 14*b*), it can be discarded and replaced with a new, empty media screening device 210. Thus, the media screening device 210 can be formed of a single unitary body (e.g., molded, 3D printed) that only has the screening openings that are the openings 226 (i.e., it has no other openings, or access features, to access the inner chamber 222). It should be apparent that the spherically shaped body of the media screening device 210 can have the same features and advantages as discussed with reference to the media screening device 110 of FIG. 3A, such as the openings 226 each comprising a counterbore, for instance, and such as the media screening device 110 being freely movable about the media slurry 113 of the deburring machine 112 to capture noncompliant media (e.g., 114*b*).

Note that the position of the openings discussed herein (e.g., 26, 66, 126, 226) can be in a patterned array around the respective housing(s), or the positions can be sporadic or random. In some examples, at least two openings can be positioned per one square inch of radial surface of the respective housing, and in some examples, at least two openings can be positioned per radial inch around the circumference of the respective housing. Other opening densities are contemplated and are possible as needed or desired.

The "dynamic zone of capture" for any particular media screening device described herein can be defined as a certain volume of deburring media slurry within the deburring machine basin (28, 128) in the process of being screened by a media screening device, and which is constantly changing. Because the media screening devices exemplified herein are freely movable, or unattached to any structure or device, they can freely move about the media slurry to provide this dynamic zone of capture to maximize the amount of noncompliant media captured by the media screening device. That is, the zone of capture for capturing noncompliant media via a particular media screening device (e.g., 10, 50, 110, 210) can constantly change, or dynamically change, because the media screening device is free to move and rotate about the media slurry. This is advantageous over other systems where a screening device is tethered or coupled to a structure and has a static or nonmoving zone of capture, which limits its zone of capture about a media slurry. Thus, the media screening devices exemplified herein perform better in this respect, which reduces the likelihood of noncompliant media being lodged in a particular hardware part.

The media screening device examples discussed herein can be formed of plastic, polymer, metal, composite, fiber glass, carbon fiber, or combinations thereof, and components thereof can be formed by extrusion, molding, machining, printing, or other processes of forming known in the art. In addition, the configurations, sizes, shapes, etc. of the media screening devices, as well as the housing enclosure configurations and coupling interfaces, discussed herein and shown in the drawings are not intended to be limiting in any way. Indeed, other configurations are contemplated, and are intended to fall within the scope of the present technology.

Figure 5:
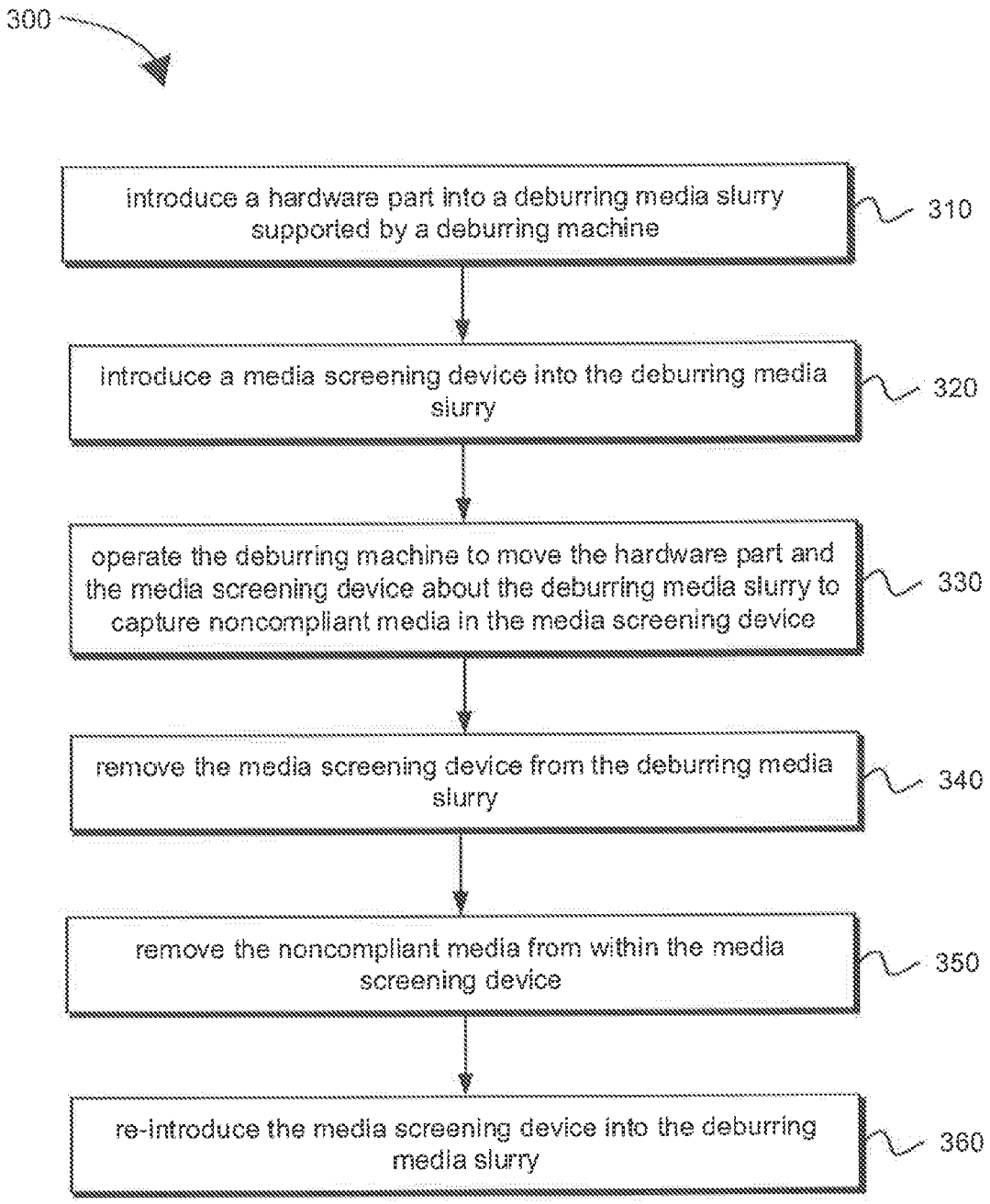
FIG. 5 illustrates a method for screening deburring media in accordance with an example of the present disclosure.

FIG. 5 is a block diagram illustrating a method 300 for screening deburring media in accordance with an example of the present disclosure. The method can comprise step 310, introducing a hardware part (e.g., 16, 116) into a deburring media slurry (e.g., 13, 113) supported by a deburring machine (e.g., 12, 112), such as described regarding FIGS. 1A-4. The method can comprise step 320, introducing a media screening device (e.g., 10, 50, 110, 210) into the deburring media slurry. The method can comprise step 330, operating the deburring machine to move the hardware part and the media screening device about the deburring media slurry to capture noncompliant media in the media screening device, such as described regarding FIGS. 1A-4. The method can comprise step 340, removing the media screening device from the deburring media slurry, and step 350 of removing the noncompliant media from within the media screening device, and step 360 of re-introducing the media screening device into the deburring media slurry, such as described regarding FIGS. 2 and 4, and elsewhere in the disclosure. Of course, the above steps can be performed without necessarily introducing the hardware part into the deburring machine. Indeed, while the media screening devices discussed herein can operate in real-time during the deburring of a hardware part, this is not necessary. The deburring machine can be operated with the media screening device deposited into the media slurry without a hardware part being placed therein and outside of a deburring process.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A system for screening deburring media during deburring operations of a hardware part, comprising:

a deburring machine comprising a media slurry basin;

a deburring media slurry disposed in the media slurry basin, the deburring machine operable to agitate the deburring media slurry;

a media screening device freely movable within the deburring media slurry to define a dynamic zone of capture, the media screening device configured to capture noncompliant deburring media, the media screening device comprising a housing defining an inner chamber and having a plurality of openings, each opening sized to restrict compliant deburring media from passing through the opening, and each opening sized to permit passage of noncompliant deburring media into the inner chamber, thereby capturing the noncompliant deburring media within the media screening device, wherein each opening comprises an outer opening area and an inner opening area, wherein the outer opening area is sized larger than the inner opening area, and wherein at least some of the openings comprise an extended opening portion extending from an inner surface of a wall of the housing into the inner chamber.

2. The system of claim 1, wherein the media screening device comprises at least one housing enclosure removably coupled to the housing to facilitate removal of captured noncompliant deburring media.

3. The system of claim 1, wherein the deburring machine comprises a tub-type deburring machine configured to agitate the deburring media slurry generally around a horizontal axis and generally in a wave motion, and wherein the media screening device comprises a generally cylindrical housing configured to move generally around the horizontal axis and to rotate around its own horizontal axis.

4. The system of claim 1, wherein the deburring machine comprises a bowl-type deburring machine configured to agitate the deburring media slurry around a vertical axis and generally in a whirlpool motion, and wherein the media screening device comprises a generally spherical housing configured to move generally around the vertical axis and to rotate about its own axis.

5. The system of claim 1, wherein the media screening device is configured to capture noncompliant media in real-time during a deburring operation of a hardware part.

6. The system of claim 1, wherein the media screening device is unattached to the deburring machine.

7. A method for screening deburring media during deburring of a hardware part, comprising:

introducing media slurry into a deburring machine;

introducing a media screening device into the deburring media slurry, the media screening device freely movable within the deburring media slurry to define a dynamic zone of capture, the media screening device comprising a housing defining an inner chamber and having a plurality of openings, each opening sized to restrict compliant deburring media from passing through the opening, and each opening sized to permit passage of noncompliant deburring media into the inner chamber, thereby capturing the noncompliant deburring media within the media screening device, wherein each opening comprises an outer opening area and an inner opening area, wherein the outer opening area is sized larger than the inner opening area, and wherein at least some of the openings comprise an extended opening portion extending from an inner surface of a wall of the housing into the inner chamber; and operating the deburring machine to move the media screening device about the deburring media slurry, thereby facilitating capture of noncompliant media in the media screening device.

8. The method of claim 7, further comprising:

removing the media screening device from the deburring media slurry;

removing the noncompliant media from within the media screening device; and re-introducing the media screening device into the deburring media slurry.

9. The method of claim 7, further comprising introducing a hardware part into the media slurry, and maintaining the hardware part in the deburring media slurry with the media screening device during a deburring process, thereby maintaining a single production flow of the hardware part.

10. The method of claim 7, further comprising deburring a hardware part and screening the media slurry with the media screening device simultaneously in real-time.

11. The method of claim 7, further comprising facilitating free movement of the media screening device about the deburring media slurry, whereby the media screening device is unattached to the deburring machine.

12. A media screening device operable with a deburring machine, comprising:

a housing comprising at least one wall defining an inner chamber, and configured to be freely movable about a deburring media slurry of a deburring machine;

a plurality of openings disposed through the at least one wall, each opening comprising an outer opening area and an inner opening area, wherein the outer opening area is sized larger than the inner opening area, and wherein the inner opening area is sized to restrict compliant deburring media from passing through the inner opening area opening, and sized to permit noncompliant deburring media to pass through the inner opening area, thereby capturing the noncompliant deburring media within the inner chamber, wherein one or more of the openings comprises an extended opening portion extending from an inner surface of the wall into the inner chamber; and at least one removable housing enclosure removably coupled to the housing to facilitate removal of captured noncompliant deburring media.

13. The media screening device of claim 12, wherein the plurality of openings are radially formed through the at least one wall.

14. The media screening device of claim 12, wherein each opening comprises a counterbore formed through the at least one wall.

15. The media screening device of claim 12, wherein the outer opening area is sized to trap at least some noncompliant media before passing through the inner opening area.

16. The media screening device of claim 12, wherein the housing comprises a generally cylindrical housing.

17. The media screening device of claim 12, wherein the at least one removable housing enclosure comprises an end cap removably coupled to an end of the generally cylindrical housing.

18. The media screening device of claim 12, wherein the at least one removable housing enclosure comprises a first housing body and a second housing body defining the housing, wherein the first housing body is removably coupled to the second housing body to facilitate removal of the noncompliant media captured in the inner chamber.

19. The media screening device of claim 12, wherein the housing comprises a generally spherical housing.

20. The media screening device of claim 19, wherein the at least one removable housing body comprises a cover removably coupled to the housing to facilitate removal of the noncompliant media captured in the inner chamber.

* * * * *